US005809808A

United States Patent [19]

Andriano et al.

[11] Patent Number: 5,809,808

[45] Date of Patent: Sep. 22, 1998

[54] CLUTCH BEARING FOR CLOTHES WASHER TRANSMISSION

[75] Inventors: Steve Andriano, Fort Dodge; Brian Schultz, Duncombe, both of Iowa

[73] Assignee: White Consolidated Industries, Inc., Cleveland, Ohio

[21] Appl. No.: 797,753

[22] Filed: Feb. 7, 1997

[51] Int. Cl.[6] ..... D06F 37/40

[52] U.S. Cl. ..... 68/23.7; 68/133; 68/134; 74/25

[58] Field of Search ..... 68/23.6, 23.7, 68/133, 134; 74/25, 36

[56] References Cited

U.S. PATENT DOCUMENTS

| | | | |
|---|---|---|---|
| 2,807,951 | 10/1957 | Gerhardt et al. | 68/23.7 |
| 2,826,055 | 3/1958 | Frey | 68/23.7 |
| 2,845,156 | 7/1958 | Dayton | 68/23.7 |
| 2,930,215 | 3/1960 | Smith | 68/23.3 |
| 2,946,409 | 7/1960 | Jennings | 68/23.7 |
| 2,964,974 | 12/1960 | Loutrel | 68/23.7 |
| 3,090,472 | 5/1963 | Morrinson | 68/23.7 |
| 3,264,847 | 8/1966 | Johnson et al. | 68/23.7 |
| 3,783,652 | 1/1974 | Archbold | 68/23.7 |
| 4,283,928 | 8/1981 | Stone | 68/23.7 |
| 4,395,890 | 8/1983 | Goodlaxson | 68/133 |
| 5,491,859 | 2/1996 | Richardson | 68/133 |
| 5,509,284 | 4/1996 | Hauser . | |

OTHER PUBLICATIONS

The Torrington Company, Service Catalog, Copyright 1988, pp. 446–451, "Drawn Cup Roller Clutches".

*Primary Examiner*—Frankie L. Stinson
*Attorney, Agent, or Firm*—Pearne, Gordon, McCoy & Granger LLP

[57] ABSTRACT

A transmission for a washing machine includes a housing, an agitator shaft rotatably mounted to the housing, and an input shaft rotatably mounted to the housing. A one-way clutch connects the input shaft and the housing which permits relative rotation between the input shaft and the housing in a first direction and prevents relative rotation between the input shaft and the housing in a second direction. An agitation system connects the input shaft and the agitator shaft whereby rotation of the input shaft relative to the housing provides back-and-forth agitation of the agitator shaft. A one-way clutch ball bearing rotatably and axially supports the housing. The one-way clutch ball bearing is a sprag type-clutch which prevents rotation of the housing in the first direction and permits rotation of the housing in the second direction.

18 Claims, 4 Drawing Sheets

CLUTCH BEARING FOR CLOTHES WASHER TRANSMISSION

BACKGROUND OF THE INVENTION

The present invention pertains to a domestic washing machine and, more particularly, to a transmission which both agitates and spins appropriate members of the washing machine.

Automatic washing machines typically hold clothing or other fabric articles in a perforate basket, immerse the clothing in water, and wash the clothing under the influence of oscillating agitator. After washing, the clothing is rinsed with water and the basket is rotated at a high speed to centrifugally extract the rinse water from the clothing and the basket. Typically, a mechanical transmission produces the oscillatory motion of the agitator upon rotation of a drive motor in one direction and produces the continuous rotation the basket upon rotation of the drive motor in the other direction.

U.S. Pat. No. 5,509,284, the disclosure of which is expressly incorporated herein in its entirety by reference, is exemplary of such transmissions. The '284 patent discloses a transmission having an input shaft connected to an agitator shaft with an off-center gear in combination with a rack and pinion mechanism to produce an oscillatory motion of the agitator shaft from the rotary motion of the input shaft.

A first limited grip spring (LGS) or one-way spring clutch connects the housing to the input shaft. The first spring clutch permits the input shaft to rotate relative to the housing when the input shaft is rotated in a first direction so that the agitator shaft is oscillated. The first spring clutch also permits the housing to rotate with the input shaft when the input shaft is rotated in a second direction so that the basket, which is attached to the housing, is rotated at high speed. A second limited grip spring (LGS) or one-way spring clutch, which is larger than the first spring clutch, connects the housing to a stationary support. The second spring clutch prevents the housing from rotating in the first direction and permits the housing to rotate in the second direction.

This type of transmission suffers from several disadvantages. The transmission produces a relatively large amount of noise during operation of the washing machine. The large amount of noise is partly due to the spring clutches, particularly the larger spring clutch. Additionally, the transmission requires many critical dimensions at the interfaces of the spring clutches. Furthermore, the transmission requires a large number of parts and associated operations and processes during assembly. Accordingly, there is a need for an improved transmission that produces less noise, requires a smaller number of critical dimensions, and requires a smaller number of parts.

SUMMARY OF THE INVENTION

The present invention provides an improved transmission for a washing machine which overcomes at least some of the above-noted problems of the prior art. The transmission includes a housing, an agitator shaft rotatably mounted to the housing, and an input shaft rotatably mounted to the housing. A one-way clutch connects the input shaft and the housing which permits relative rotation between the input shaft and the housing in a first direction and prevents relative rotation between the input shaft and the housing in a second direction. An agitation system connects the input shaft and the agitator shaft whereby rotation of the input shaft relative to the housing provides back-and-forth agitation of the agitator shaft. A one-way clutch bearing rotatably and axially supports the housing which prevents rotation of the housing in the first direction and permits rotation of the housing in the second direction.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
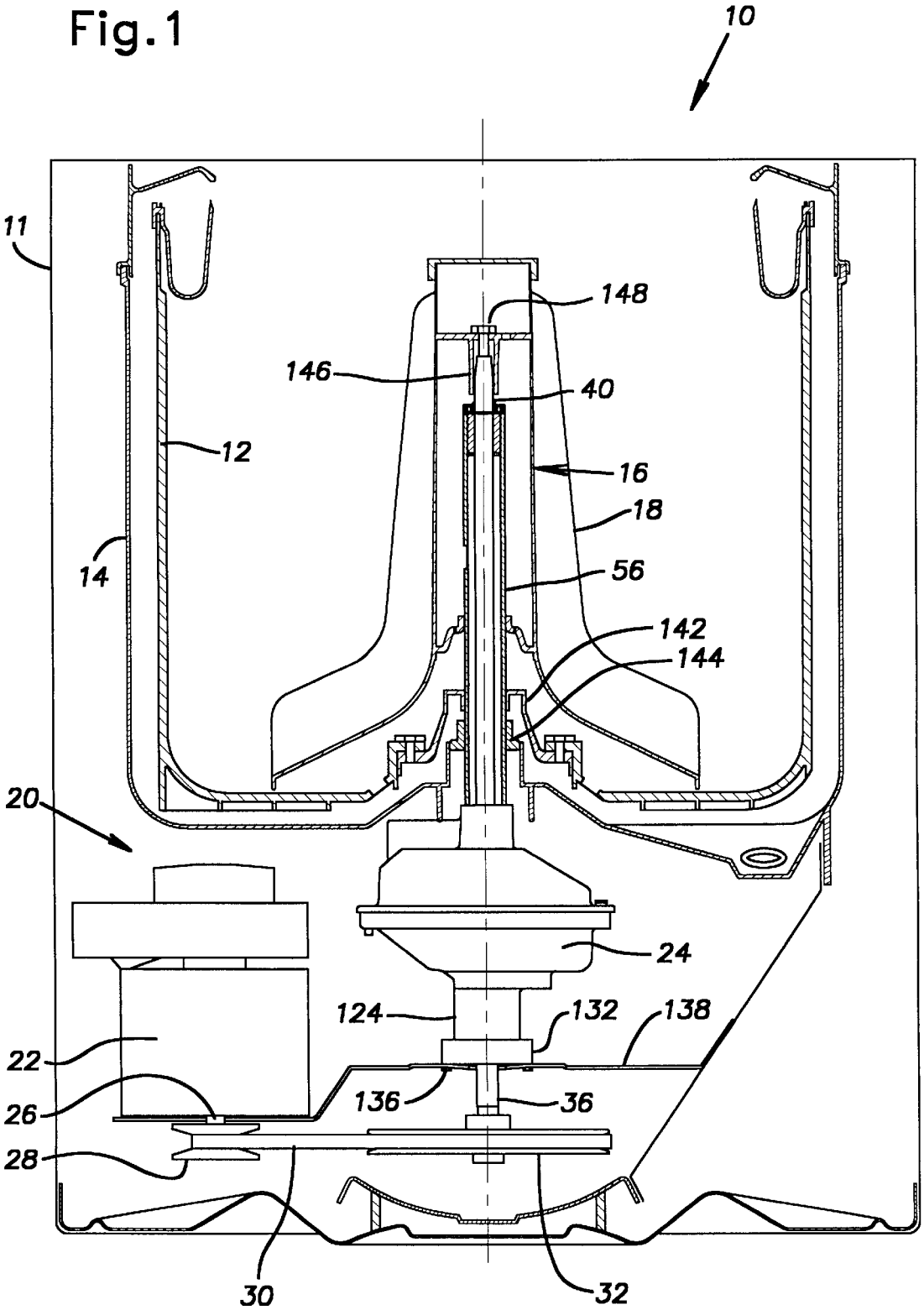
FIG. 1 is an elevational view, in cross-section, of a washing machine according to the present invention.

FIG. 1 illustrates a domestic clothes washing machine 10 according to the present invention. The washing machine 10 includes a cabinet 11 having a door (not shown) pivotally mounted at an upper surface to permit access into the interior of the washing machine 10. The washing machine 10 also includes a perforated inner wash tub 12 which is surrounded by an imperforate outer wash tub 14. An agitator 16 is located within the inner tub 12 and has a series of upstanding vanes 18 formed thereon. A control console (not shown) is typically provided at a rear of the upper surface which includes control knobs and switches to allow a user to select a desired operating cycle or sequence of cycles for the washing machine 10.

Clothes or other articles to be washed are loaded into the inner tub 12 and the desired operating cycle is initiated. Typically, the operating cycle includes filling the outer tub 14 with wash water, oscillating the agitator 16 so that the vanes 18 engage and mix the clothes and wash water contained within the inner tub 12, draining wash fluid from the outer tub 14, filling and draining the outer tub 14 one or more times with rinse water, and spinning the inner tub 12 to centrifugally extract water from the articles therein.

The washing machine 10 includes a drive system 20 which both oscillates the agitator 16 and spins the inner tub 12. The drive system 20 includes a reversible electric motor 22 and a transmission 24. The motor 22 has a vertical axis output shaft 26 and drive pulley 28 mounted on the output shaft 26. The motor 22 rotatably drives the transmission 24 with a drive belt 30 connecting the drive pulley 28 to a transmission pulley 32. The transmission 24 has two alternative modes of operation depending on the direction of rotation of the motor output shaft 26. In a first or agitation mode, the transmission 24 operates to oscillate the agitator 16 within the inner tub 12. In a second or spin mode, the transmission 24 operates to spin the inner tub 12 within the outer tub 14. It is submitted that the foregoing generally describes a rather well-known or conventional washing machine assembly, and is provided herein only to clarify the environment in which the present invention, to be described hereafter, is employed.

Figure 2:
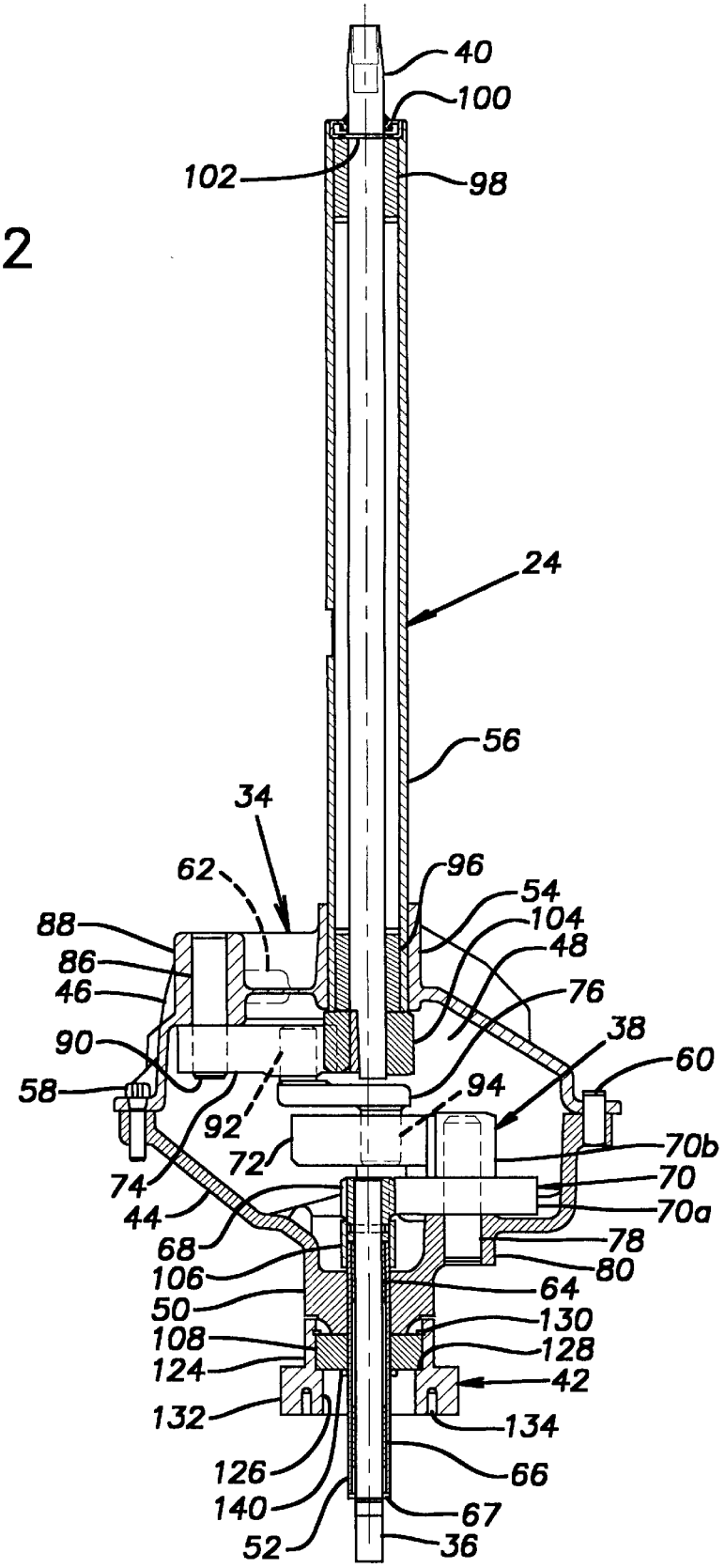
FIG. 2 is an elevational view in cross-section of the transmission of the washing machine of FIG. 1.

As best shown in FIG. 2, the transmission 24 includes a housing 34, an input shaft 36, an agitation system 38, an agitator shaft 40, and a clutch/bearing system 42. The housing 34 includes separable lower and upper housing sections 44, 46 which may be machined from suitably formed metal castings. The lower and upper housing sections 44, 46 together form an interior cavity 48 and generally enclose the components of the transmission 24. The lower housing section 44 has, at its lower end, a collar portion or hub 50 with a cylindrical bore. A lower housing extension or input tube 52 is tightly received within the cylindrical bore of the hub 50 and downwardly extends from the lower housing section 44. The upper housing section 46 has, at its upper end, a collar portion or hub 54 with a cylindrical bore. An upper housing extension or agitator tube 56 is tightly received in the cylindrical bore of the hub 54 and upwardly extends from the upper housing section 46.

The upper housing section 46 is secured to the lower housing section 44 with fastening members 58 such as, for example, hex screws which extend through openings in the upper housing section 46 and into threaded holes in the lower housing section 44. One or more dowel or spring pins 60 are pressed into suitable holes in one of the housing sections 44, 46 while cooperating holes are formed in the opposite section to permit the housing sections 44, 46 to be indexed to one another on the plane of separation. A port in the upper housing section 46 permits the interior cavity 48 of the housing 34 to be filled or emptied of lubricant after a plug 62 is removed therefrom. A seal is obtained between the upper and lower housing sections 44, 46 to prevent leakage of the lubrication out of the housing 34 along the plane of separation.

The input shaft 36 is rotatively mounted, relative to the input tube 52 and lower housing section 44, within the input tube 52 and extends out the top and bottom of the input tube 52. The inside of the input tube 52 is provided with sleeve bearings 64, 66 at the top and bottom of the input tube 52. Preferably, a seal 67 is provided between the input shaft 36 and the input tube 52 at the bottom of the input tube 52 below the bottom sleeve bearing 66.

An input pinion 68 is secured to the upper end of the input shaft 36 for drivingly connecting the input shaft 36 with the agitator system 38. Suitable means are provided to secure the input pinion 68 to the input shaft 36 for rotation therewith such as, for example, a spline and retaining ring.

The agitation system 38 alters the constant unidirectional rotation of the input shaft 36 into an oscillating motion, that is a back-and-forth rotational movement, of the agitator shaft 40. The agitation system 38 includes an idler gear 70, a crank gear 72, a sector gear 74, and a connecting rod 76.

The idler gear 70 is rotatively mounted within the housing 34 on a vertically extending idler shaft 78. The lower end of the idler shaft 78 is press-fit into a vertical bore provided in a boss 80 on the underside of the lower housing section 44. The upper end of the idler shaft 78 extends through a central bore of the idler gear 70 such that the idler gear 70 is rotatable about the idler shaft 78. The teeth of a lower portion 70*a* of the idler gear 70 are meshed with the teeth of the input pinion 68 so that rotation of the input shaft 36 and input pinion 68 directly rotates the idler gear 70 about the idler shaft 78.

Figure 3:
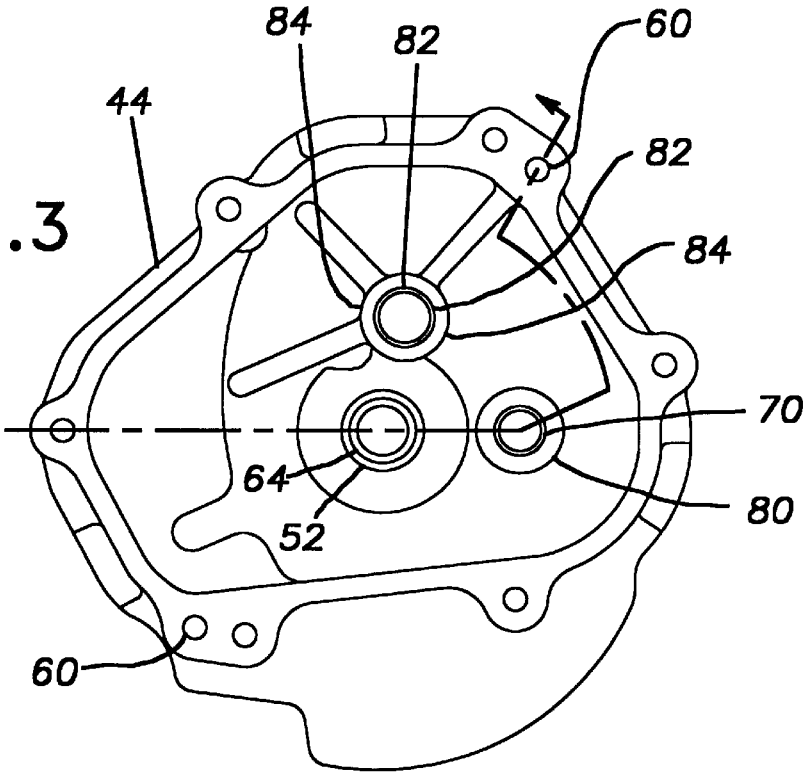
FIG. 3 is a top plan view of a lower housing section of the transmission of FIG. 2.
Figure 4:
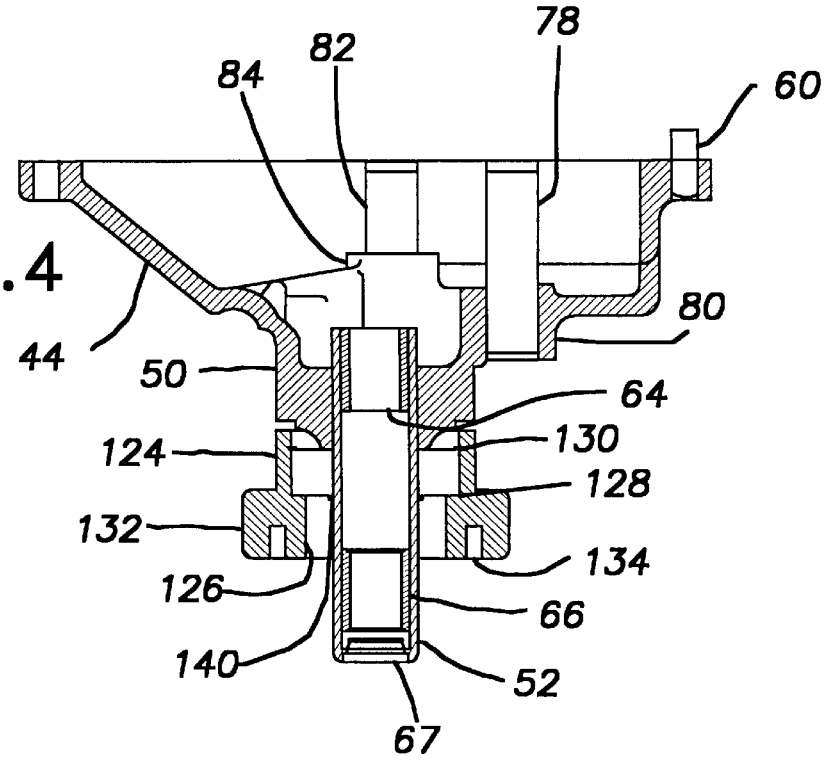
FIG. 4, is an elevational view, in cross-section, of the lower housing section taken along line 4—4 of FIG. 3.

The crank gear 72 is rotatively mounted within the housing 34 on a vertically extending crank shaft 82 (best shown in FIGS. 3 and 4). The lower end of the crank shaft 82 is press-fit into a vertical bore provided in a boss 84 on the underside of the lower housing section 44. The upper end of the crank shaft 82 extends through a central bore of the crank gear 72 such that the crank gear 72 is rotatable about the crank shaft 82. The teeth of the crank gear 72 are meshed with the teeth of an upper portion 70*b* of the idler gear 70 so that rotation of the idler gear 70 directly rotates the crank gear 72 about the crank shaft 82.

The sector gear 74 is rotatively mounted within the housing 34 on a vertically extending sector shaft 86. The upper end of the sector shaft 86 is press-fit into a vertical bore provided in a boss 88 on the upper side of the upper housing section 46. The lower end of the sector shaft 86 extends through a central bore of the sector gear 74 such that the sector gear 74 is rotatable about the sector shaft 86. A retaining ring 90 is provided to secure the sector gear on the sector shaft 86.

The connecting rod 76 connects the crank gear 72 with the sector gear 74 so that rotation of the crank gear 72 oscillates the sector gear 74. A first end of the connecting rod 76 has a downwardly extending first stub shaft 92 and a second end of the connecting rod 76 has an upwardly extending second stub shaft 94. The first stub shaft 92 extends into an eccentric bore of the crank gear 72 such that the first stub shaft 92 is rotatable within the bore of the crank gear 72. The second stub shaft 94 extends into an eccentric bore of the sector gear 74 such that the second stub shaft 94 is rotatable within the bore of the sector gear 74. As the crank gear 72 rotates, the connecting rod 76 oscillates the sector gear 74 about the sector shaft 86.

The agitator shaft 40 is rotatively mounted, relative to the agitator tube 56, within the agitator tube 56 and extends out the top and bottom of the agitator tube 56. The inside of the agitator tube 56 is provided with a flange bearing 96 at the bottom of the agitator tube 56 and a sleeve bearing 98 at the top of the agitator tube 56. Preferably, a seal 100 is provided between the agitator shaft 40 and the agitator tube 56 at the top of the agitator tube 56 above the sleeve bearing 98. The agitator shaft 40 is provided with a retaining ring 102 at the top of the sleeve bearing 98 below the seal 100 to retain the agitator shaft within the agitator tube 56.

An agitator gear 104 is secured to the lower end of the agitator shaft 40. Suitable means are provided to secure the agitator gear 104 to the agitator shaft 40 for rotation therewith such as, for example, a spline and retaining ring. Teeth of the agitator gear 104 mesh with teeth of the sector gear 74 so that oscillation of the sector gear 74 directly oscillates the agitator gear 104 and the agitator shaft 40.

The clutch/bearing system 42 includes a first one-way clutch and a second one-way clutch which is a clutch bearing 108. The first one-way clutch is preferably a limited grip spring (LGS) or helical spring clutch 106. The spring clutch 106 encircles the exterior surface of an upper portion of the input tube 52 and the exterior surface of a hub or bottom portion of the input pinion 68. The hub portion of the input pinion 68 has an outer diameter substantially equal to the outer diameter of the input tube 52. It is noted that, alternatively, a separate hub can be provided which is splined on the upper end of the input shaft 36 between the input pinion 68 and a upward facing shoulder or abutment on the input shaft 36.

The spring clutch 106 is dimensioned for an interference fit with both the input tube 52 and the hub portion of the input pinion 68 to form the first one-way clutch. In one direction of rotation of the input shaft 36, corresponding to the agitation mode (clockwise as viewed down into the inner tub 12), the spring clutch 106 releases and allows the input shaft 36 to rotate relative to the input tube 52 and housing 34. In the other direction of rotation of the input shaft 36, corresponding to the spin mode (counterclockwise as viewed down into the inner tub 12), the spring clutch 106 constricts and grips to transmit torque between input shaft 36 and the input tube 52, and thereby the housing 34, so that the transmission 24 rotates as one rigid body about the vertical axis of the input and agitator shafts 36, 40.

Figure 6:
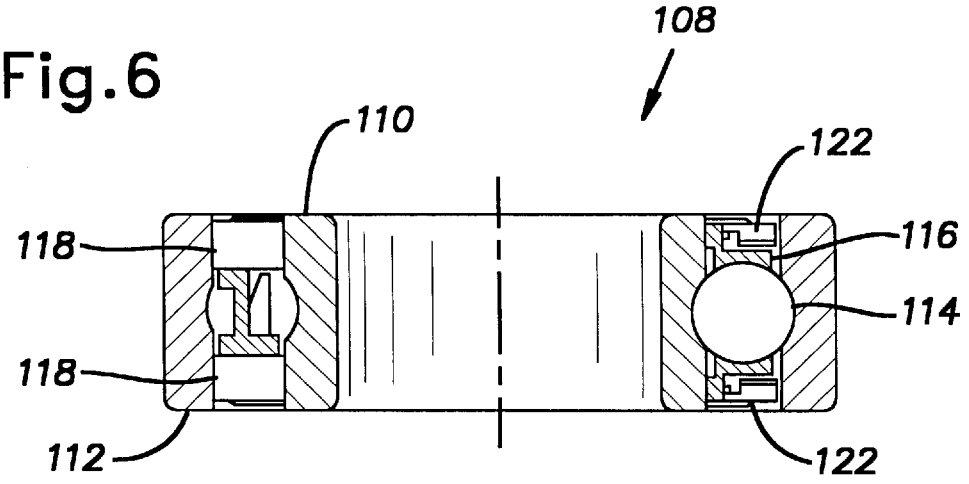
FIG. 6 is an elevational view, in cross-section, taken along line 4—4 of FIG. 5.
Figure 5:
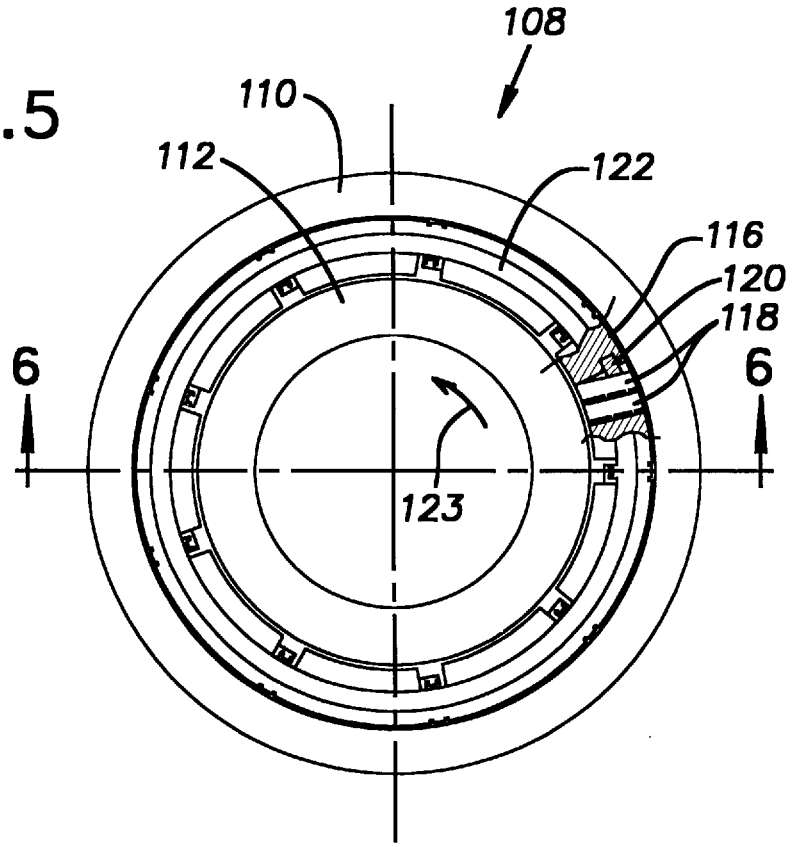
FIG. 5 is a top plan view of a one-way clutch bearing of the transmission of FIG. 2.

The clutch bearing 108 is both a one-way clutch which allows relative rotation in one direction but transmits torque in the other direction and a rolling-contact bearing which supports both radial and axial loads. The clutch bearing 108 is preferably a sprag-type clutch and is preferably a ball-type bearing. As best shown in FIGS. 5 and 6, the clutch bearing 108 of the illustrated embodiment has inner and outer races or rings 110, 112, a plurality of rolling contact elements or balls 114, a retainer or cage 116, a plurality of friction members or sprags 118, a plurality of spring members 120, and a pair of shields 122.

The inner and outer rings 110, 112 cooperate to form a raceway or groove for the balls 114. The balls 114 are located between the inner and outer rings 110, 112 in the groove and contact the groove at both the inner ring 110 and the outer ring 112. The cage 116 is located between the inner and outer rings 110, 112 and has ball pockets sized and shaped to separate the balls 114 with substantially equal spacing about the groove.

The sprags 118 are located in sprag pockets of the cage 116 between the ball pockets. The sprags 118 are axially located on opposite sides of the groove and generally extend from the inner ring 110 to the outer ring 112. The sprag pockets of the cage 116 are sized and shaped so that the sprags 118 are pivotable between a first or unlocking position in which the sprags 118 allow relative rotation between the inner and outer rings 110, 112 and a second or locking position in which the sprags 118 prevent relative rotation between the inner and outer rings 110, 112. The spring members 120 are positioned and sized to bias the sprags 118 into the unlocked position as best shown in FIG. 5.

With the outer ring 112 held stationary, the inner ring 110 can rotate relative to the outer ring 112 in the direction of the arrow 123 (counter-clockwise as viewed in FIG. 5) because the sprags 118 are biased to the unlocked position. The inner ring 110, however, cannot rotate relative to the outer ring 112 in the direction opposite the arrow 123 (clockwise as viewed in FIG. 5) because the rotation of the inner ring 110 overcomes the bias of the spring members 120 and pivots the sprags 118 to the locking position. The clutch bearing 108, therefore, is a one-way clutch ball bearing. The shields 122 are located between the inner and outer rings 110, 112 at the axial ends of the clutch bearing 108 and substantially close the annular space located between the inner and outer rings 110, 112. The shields 122 substantially prevent dirt or other debris from entering grease or other lubricant located at the groove.

As best shown in FIGS. 1 and 2, the outer ring 112 of the clutch bearing 108 is held stationary by a bearing retainer 124 which is generally cylindrically-shaped and has a central bore 126. The central bore 126 has an upper portion and a lower portion with a diameter smaller than the diameter of the upper portion to form an upward facing abutment 128. The upper portion of the central bore 126 is sized to receive the outer ring 112 of the clutch bearing 108 with an interference or press-fit. The upper portion of the central bore 126 is provided with a groove about the periphery of the central bore 126 that is sized and shaped for receiving a retaining ring 130 to axially secure the clutch bearing 108 against the abutment 128.

The bottom of the bearing retainer 124 has a generally rectangular shaped flange 132. The bottom surface of the flange 132 is provided with upwardly extending blind openings 134 which are generally parallel with the central bore 126. The openings 134 are located near the four corners of the flange 132 and are adapted for receiving fastening members 136.

The flange 132 of the bearing retainer is secured to a frame wall 138 of the washing machine 10 frame by the fastening members 136 such as, for example, threaded bolts, which extend upwardly through openings in the frame wall 138 and into the blind openings 134 in the flange 132 of the bearing retainer 124.

The outer ring 112 of the clutch bearing 108 is securely held in the central bore 126 of the bearing retainer with an interference or press-fit to prevent relative rotation therebetween. The outer ring 112 of the bearing is also securely held against the abutment 128 of the bearing retainer 124 by the retaining ring 130 to prevent axial movement of the clutch bearing 124 within the central bore 126.

The input tube 52 extends downwardly through the inner ring 110 of the clutch bearing 108 with a slight interference fit so that the input tube 52 is journaled in the clutch bearing 108. The outer surface of the input tube 52 is provided with a groove sized and shaped for receiving a retaining ring 140 at the bottom surface of the inner ring 110 of the clutch bearing 108. The retaining ring 140 securely holds the inner ring 110 against a bottom surface of the lower housing section 44.

Secured in this manner, the clutch bearing 108 forms the second one-way clutch which limits rotation of the housing 34 relative to the bearing retainer 124, and thereby to the frame wall 138 of the washing machine 10, to one direction. In one direction of rotation, corresponding to the direction of rotation of the input shaft 36 during the agitation mode (clockwise as viewed down into the inner tub 12), the clutch bearing 108 locks the housing 34 to the non-rotating or fixed bearing retainer 124 so that the housing 34 cannot rotate. In the other direction of rotation, corresponding to the direction of rotation of the input shaft 36 during the spin mode (counterclockwise as viewed down into the inner tub 12), the clutch bearing 108 allows the housing 34 to rotate relative to the fixed bearing retainer 124.

Secured in this manner, the clutch bearing 108 also supports the axial loads of the transmission 14, inner tub 12, and agitator 16. During operation of the washing machine 10, the axial loads include the weight of water and clothes, and any vertical force created by the motion of the agitator. The clutch bearing 108 is constructed to support the same axial load as a standard ball bearing.

As best shown in FIG. 1, the agitator shaft 40 and agitator tube 56 extend upwardly through bottom openings in the inner and outer tubs 12, 14. An attachment member 142 is secured to the bottom wall of the inner tub 12 and to the agitator tube 56 so that the inner tub 12 is rigidly secured to the agitator tube 56 and rotates with the agitator tube 94. A seal member 144 is provided between the outer tub 14 and the agitator tube 56 to prevent wash liquid within the outer tub 14 from flowing or leaking down the agitator tube 56.

The agitator 16 has a cylindrical sleeve 146 which is substantially coaxial with the agitator shaft 40 and projects downwardly from a partition wall. The agitator shaft 40 has a spline-connection with the sleeve 146 of the agitator 16 so that the agitator 16 rotates or oscillates with the agitator shaft 40. A threaded bolt 148 extends through the wall of the agitator 16 and into a threaded hole in the top of the agitator shaft 40 to secure the agitator 16 to the agitator shaft 40 and prevent relative axial or longitudinal movement between the agitator 16 and the agitator shaft 40.

At the proper time in the operation of the washing machine 10, the agitation mode is initiated by operating the motor 22 in a first or agitation direction which, through the drive belt 30 and pulleys 28, 32, drives the input shaft 36 in the first direction (clockwise as viewed down into the inner tub 12). In this first direction of rotation, the spring clutch 106 allows the input shaft 36 to rotate relative to the input tube 52, and therefore the housing 34.

The rotating input shaft 36 drives the idler gear 70 with the input pinion 68 so that the idler gear 70 rotates about the idler shaft 78. The idler gear 70 drives the crank gear 72 so that the crank gear rotates about the crank shaft 82. The first stub shaft 92, and the connecting rod 76 attached thereto, revolve around the vertical axis of the crank gear 72 as the crank gear 72 rotates. The second stub shaft 94 of the connecting rod moves the sector gear 74 about the sector shaft 86 to convert the unidirectional rotational motion of the crank gear 72 into an oscillatory motion of the sector gear 74. The sector gear 74 drives the agitator gear 104 of the agitator shaft 40 to convert the oscillatory motion of the sector gear into a reversing rotational motion of the agitator shaft 40. Therefore, the agitation system 38 converts the unidirectional rotation of the input shaft 36 into a reversing rotational movement of the agitator shaft 40. The agitator shaft 40 thereby drives the agitator 16 in a back-and-forth motion within the inner tub 12.

As discussed above, the clutch bearing 108 secures the housing 34 to the washing machine frame wall 138 so that the housing 34 cannot rotate in the first direction (clockwise as viewed down into the inner tub 12). The housing, however, can rotate in the second direction (counterclockwise as viewed down into the inner tub 12). During the agitation mode, therefore, the inner tub 12 rotates or "indexes" as the agitator 16 sweeps back in the second direction in reaction to the forces associated with the clothes load and water movement in the inner tub 12.

At the proper time in the operation of the washing machine 10, the spin mode is initiated by reversing the direction of the motor 22 from that of the agitation mode to a second or spin direction which, through the drive belt 30 and pulleys 28, 32, drives the input shaft 36 in the second direction (counter clockwise as viewed down into the inner tub 12). In this second direction of rotation, the spring clutch 106 transmits torque from the input shaft 36 to input tube 52, and therefore the housing 34, so that the entire transmission 24 rotates in unison as one rigid body. As discussed above, the clutch bearing 108 allows the housing 34 to rotate with respect to the bearing retainer 124 and the washing machine frame wall 138 in this second direction.

The rotation of the housing 34 and the agitator tube 56 spins the inner tub 12, which is secured to the agitator tube 56, within the outer tub 12 in a constant direction of rotation. Because the whole transmission 24 rotates with the input shaft 36, there is no oscillatory rotation of the agitator shaft 40 and the agitator 16 spins with the inner tub 12 without agitation.

Although particular embodiments of the invention have been described in detail, it will be understood that the invention is not limited correspondingly in scope, but includes all changes and modifications coming within the spirit and terms of the claims appended hereto.

What is claimed is:

1. A transmission for a washing machine comprising:

a housing;

an agitator shaft rotatably mounted to said housing;

an input shaft rotatably mounted to said housing;

a one-way clutch connecting said input shaft and said housing which permits relative rotation between said input shaft and said housing in a first direction and prevents relative rotation between said input shaft and said housing in a second direction;

an agitation system connecting said input shaft and said agitator shaft whereby rotation of said input shaft relative to said housing provides back-and-forth agitation of said agitator shaft, and a one-way clutch bearing rotatably and axially supporting said housing which prevents rotation of said housing in said first direction and permits rotation of said housing in said second direction, wherein said clutch bearing includes inner and outer rings, and rolling contact bearing elements located between said inner and outer rings.

2. The transmission according to claim 1, wherein said clutch bearing is a rolling contact bearing.

3. The transmission according to claim 1, wherein said rolling contact bearing elements are balls.

4. The transmission according to claim 1, wherein said clutch bearing includes sprags between said inner and outer rings.

5. The transmission according to claim 1, wherein said housing includes a generally downwardly extending input tube with said input shaft extending through said input tube, wherein said input tube extends through said inner ring of said clutch bearing.

6. The transmission according to claim 1, further comprising a bearing retainer secured to said outer ring of said clutch bearing.

7. The transmission according to claim 1, wherein said clutch bearing supports both radial and axial loads.

8. A transmission for a washing machine comprising:

a housing;

an agitator shaft rotatably mounted to said housing;

an input shaft rotatable mounted to said housing;

a one-way clutch connecting said input shaft and said housing which permits relative rotation between said input shaft and said housing in a first direction and prevents relative rotation between said input shaft and said housing in a second direction;

an agitation system connecting said in put shaft and said agitator shaft whereby rotation of said input shaft relative to said housing provides back-and-forth agitation of said agitator shaft, and a one-way clutch bearing rotatably and axially supporting said housing which prevents rotation of said housing in said first direction and permits rotation of said housing in said second direction, wherein said clutch bearing includes inner and outer rings and sprags located between said inner and outer rings.

9. A washing machine comprising:

a cabinet;

an outer wash tub within said cabinet;

a perforate inner wash tub located within said outer wash tub;

an agitator located within said inner wash tub;

a transmission having a housing connected to said inner wash tub, an agitator shaft rotatably mounted to said housing and connected to said agitator, an input shaft rotatably mounted to said housing, a one-way clutch connecting said input shaft and said housing which permits relative rotation between said input shaft and said housing in a first direction and prevents relative rotation between said input shaft and said housing in a second direction, an agitation system connecting said input shaft and said agitator shaft whereby rotation of said input shaft relative to said housing provides back-and-forth agitation of said agitator shaft, and a one-way clutch bearing axially supporting said housing which prevents rotation of said housing in said first direction and permits rotation of said housing in said second direction, wherein said clutch bearing includes inner and outer rings, and rolling contact bearing elements located between said inner and outer rings; and a reversible electric motor drivingly connected to said input shaft of said transmission.

10. The washing machine according to claim 9, wherein said clutch bearing is a rolling contact bearing.

11. The washing machine according to claim 9, wherein said wherein said rolling contact bearing elements are balls.

12. The washing machine according to claim 9, wherein said clutch bearing includes sprags between said inner and outer rings.

13. The washing machine according to claim 9, wherein said housing includes a generally downwardly extending input tube with said input shaft extending through said input tube, and said input tube extends through said inner ring of said clutch bearing.

14. The washing machine according to claim 9, further comprising a bearing retainer secured to said outer ring of said clutch bearing.

15. The washing machine according to claim 14, wherein said bearing retainer is attached to a stationary support member of said washing machine.

16. The washing machine according to claim 9, wherein said clutch bearing supports both radial and axial loads.

17. A washing machine comprising:

a cabinet;

an outer wash tub within said cabinet;

a perforate inner wash tub located within said outer wash tub;

an agitator located within said inner wash tub;

a transmission having a housing connected to said inner wash tub, an agitator shaft rotatably mounted to said housing and connected to said agitator, an input shaft rotatable mounted to said housing, a one-way clutch connecting said input shaft and said housing which permits relative rotation between said input shaft and said housing in a first direction and prevents relative rotation between said input shaft and said housing in a second direction, an agitation system connecting said input shaft and said agitator shaft whereby rotation of said input shaft relative to said housing provides back-and-forth agitation of said agitator shaft, and a one-way clutch bearing axially supporting said housing which prevents rotation of said housing in said first direction and permits rotation of said housing in said second direction, wherein said clutch bearing includes inner and outer rings and sprags located between said inner and outer rings; and a reversible electric motor drivingly connected to said input shaft of said transmission.

18. A washing machine comprising:

a cabinet;

an outer wash tub within said cabinet;

a perforate inner wash tub located within said outer wash tub;

an agitator located within said inner wash tub;

a transmission having a housing connected to said inner wash tub, an agitator shaft rotatably mounted to said housing and connected to said agitator, an input shaft rotatably mounted to said housing, a one-way clutch connecting said input shaft and said housing which permits relative rotation between said input shaft and said housing in a first direction and prevents relative rotation between said input shaft and said housing in a second direction, an agitation system connecting said input shaft and said agitator shaft whereby rotation of said input shaft relative to said housing provides back-and-forth agitation of said agitator shaft, a one-way clutch ball axially supporting said housing which prevents rotation of said housing in said first direction and permits rotation of said housing in said second direction, said clutch bearing including inner and outer rings, balls located between said inner and outer rings, and sprags located between said inner and outer rings, said housing including a generally downwardly extending input tube with said input shaft extending through said input tube, said input tube extending through said inner ring of said clutch bearing, and a bearing retainer secured to said outer ring of said clutch bearing and mounted to a stationary member of said washing machine; and a reversible electric motor drivingly connected to said input shaft of said transmission.

* * * * *